United States Patent [19]

Keller, Jr. et al.

[11] Patent Number: 4,770,766

[45] Date of Patent: Sep. 13, 1988

[54] TIME-CONTROLLED PROCESSES FOR AGGLOMERATING COAL

[75] Inventors: Douglas V. Keller, Jr., Lafayette; William M. Burry, Jamesville, both of N.Y.

[73] Assignee: Otisca Industries, Ltd., Syracuse, N.Y.

[21] Appl. No.: 839,902

[22] Filed: Mar. 12, 1986

[51] Int. Cl.[4] ..... B03B 1/04; C10L 9/10; B02C 23/18

[52] U.S. Cl. ..... 209/5; 44/620; 210/729; 241/16; 241/20

[58] Field of Search ..... 209/3–5; 44/1 R, 1 SR, 51; 210/729; 23/313 R; 208/426, 435; 241/15, 16, 20, 24

[56] References Cited

U.S. PATENT DOCUMENTS

| | | | |
|---|---|---|---|
| 2,744,626 | 5/1956 | Reerink et al. . | |
| 2,769,537 | 11/1956 | Reerink et al. . | |
| 2,769,538 | 11/1956 | Reerink et al. . | |
| 2,781,904 | 2/1957 | Reerink et al. . | |
| 2,842,319 | 7/1958 | Reerink et al. . | |
| 2,859,917 | 11/1958 | Reerink et al. . | |
| 3,045,818 | 7/1962 | Muschenborn et al. . | |
| 3,268,071 | 8/1966 | Puddington et al. | 209/5 |
| 3,637,464 | 1/1972 | Walsh et al. . | |
| 3,763,139 | 10/1973 | Falkehag | 210/730 X |
| 3,988,120 | 10/1976 | Chia | 44/1 SR |
| 4,033,729 | 7/1977 | Capes et al. . | |
| 4,124,485 | 11/1978 | Carr et al. | 208/435 X |
| 4,186,887 | 2/1980 | Keller, Jr. et al. | 209/5 X |
| 4,210,531 | 7/1980 | Wang et al. | 209/5 X |
| 4,248,698 | 2/1981 | Keller, Jr. | 209/5 |
| 4,249,699 | 2/1981 | Smith et al. | 209/5 X |
| 4,261,699 | 4/1981 | Sun et al. . | |
| 4,270,926 | 6/1981 | Burk, Jr. et al. | 44/1 SR |
| 4,272,250 | 6/1981 | Burk, Jr. et al. | 44/1 SR |
| 4,302,211 | 11/1981 | Verschuur . | |
| 4,304,573 | 12/1981 | Burgess et al. | 44/1 R X |
| 4,311,488 | 1/1982 | Verschuur . | |
| 4,360,425 | 11/1982 | Lim et al. | 209/5 X |
| 4,388,181 | 6/1983 | Rainis et al. . | |
| 4,406,664 | 9/1983 | Burgess et al. | 44/1 R X |
| 4,437,861 | 3/1984 | Ishizuka et al. | 44/1 R |
| 4,447,245 | 5/1984 | Smith et al. | 44/1 SR |
| 4,484,928 | 11/1984 | Keller, Jr. | 44/1 SR |
| 4,583,990 | 4/1986 | McGarry et al. | 44/1 R X |
| 4,601,729 | 7/1986 | Capes et al. | 44/1 R X |
| 4,618,414 | 10/1986 | Hartan et al. | 209/5 |

OTHER PUBLICATIONS

Agglomeration 77, vol. 2, K.V.S. Sastry, Ed., American Institute of Mining, Metallurgical and Petroleum Engineers, Inc., New York, New York, 1977, Chapters 54–56, pp. 910–951.

*Primary Examiner*—Robert B. Reeves
*Assistant Examiner*—Edward M. Wacyra
*Attorney, Agent, or Firm*—Hughes, Cassidy & Multer

[57] ABSTRACT

Methods of recovering agglomerated particles of a carbonaceous constituent such as coal from a composite of that constituent and mineral matter. An additive is incorporated into a slurry of the composite to control the agglomeration time and/or to insure that the carbonaceous particles will agglomerate. Appropriate additives are:

Naturally occurring hydrocarbonaceous substances such as road asphalts, Gilsonite, pentane extracts of coals, tar sands oils, coal tars, and alcohols having six or more carbon atoms Castor oil Isopropyl ether Hydrolized linseed oil 2-Ethylhexyl acetate Ionic dispersants such as ammonium salts of lignosulfonates Nonionic dispersants such as dextrins A compound having the formula R—O—R, $R_2$—CO, R—COOH, or R—COOR where R is an aliphatic moiety having at least six carbon atoms.

70 Claims, No Drawings

TIME-CONTROLLED PROCESSES FOR AGGLOMERATING COAL

TECHNICAL FIELD OF THE INVENTION

The present invention relates to novel, improved agglomeration type processes for separating coal from the mineral matter associated therewith.

More particularly, the present invention relates to processes as described in the preceding paragraph in which provision is made for controlling the agglomeration time of the process; i e., the duration of that period in which the particles of coal separate from the particles of mineral matter and coalesce into product coal agglomerates of an acceptable physical structure and ash content.

Also, in another aspect, the invention relates to the product coal agglomerates generated by the processes identified in the preceding paragraph.

DEFINITIONS

Raw Coal—the feedstock for the novel agglomeration type coal recovery processes with which this disclosure is concerned. That feedstock will invariably be a composite of mineral matter and coal which is to be separated from the associated mineral matter by the agglomeration process. The feedstock may be, as examples only: as-mined coal milled or otherwise reduced to a top size which is appropriate for the process, product coal from a hydrobeneficiation plant, slurry pond coal, the black water from a hydrobeneficiation plant, or the product coal agglomerates from a preceding step of the process.

Coal Particles and Particles of Coal—particles which are at least predominantly coal but may also contain small amounts (from a few to a few hundredths weight percent) of mineral matter bound to the coal.

Mineral Matter Particles and Particles of Mineral Matter—particles which contain no coal or only a small weight percent of coal.

Product Coal Agglomerates—particles of coal bound into a structurally cohesive mass typically having the appearance and consistency of black cottage cheese.

Dispersed Slurry—a slurry in which the forces attracting the coal and mineral matter particles to each other are so weak that they do not interfere with the forces relied upon to selectively agglomerate coal in accord with the principles of the present invention.

INCORPORATION OF OTHER DISCLOSURES

U.S. Pat. Nos. 4,484,928 issued Nov. 27, 1984, to Keller, Jr. and 4,186,887 issued Feb. 5, 1980, to Keller, Jr., et al. and copending U.S. application No. 712,202 filed Mar. 15, 1985, by Keller, Jr., are hereby incorporated in this disclosure by reference.

BACKGROUND OF THE INVENTION

U.S. Pat. No. 4,484,928, which is assigned to the assignee of the present application, discloses a state-of-the-art agglomeration-type coal cleaning process for generating product coals which have an extremely low ash content and essentially no pyritic or sulfatic sulfur.

This novel, and economically important, result is obtained by milling or otherwise comminuting raw coal until it has been reduced to a top size not greater than ca. 250 $\mu m \times 0$ ($\mu m$ equals micrometer or micron). The raw coal is then slurried in an aqueous liquid, typically clean water; and comminution of the raw coal is continued until the raw coal has been resolved into separate, particulate phases of coal and mineral matter.

After this comminution step is completed: (1) the slurry is diluted to reduce its solids content to a maximum of 15 weight percent, based on the total weight of the slurry, and preferably to a solids content of 3–8 weight percent; (2) an agglomerating agent or agglomerant is added to the diluted slurry with agitation; (3) agitation of the slurry is continued until the coal particles have dissociated from the mineral matter and aqueous phases of the slurry and coalesced into agglomerates of product coal; and (4) the agglomerates are recovered from the slurry (there is virtually 100 percent recovery of the carbonaceous material in this separation).

A product coal with an even lower ash content than is available from following the steps identified above can be produced by redispersing the product coal agglomerates in clean water and repeating the agglomeration and collection steps. This sequence can be repeated as many times as wanted although it is presently believed that the benefits obtained by proceeding beyond the second or third collection step will in general not justify the expense of doing so.

No additional milling is required in the second product coal recovery stage (dispersion, agglomeration, and recovery steps) just discussed or in subsequent repetitions of this sequence of steps. Consequently, the elimination of additional mineral matter afforded by the second (and any subsequent) agglomeration stages can be effected inexpensively and with only modest expenditures of energy.

U.S. Pat. No. 4,186,887, also assigned to the assignee of the present application, is concerned with agglomeration processes much like those described in U.S. Pat. No. 4,484,928. The processes disclosed in the two patents differ in that, in those disclosed in the later issued patent, there is no milling of the raw coal during the recovery phase of the process; i.e., that phase in which the coal particles are separated from the aqueous phase of a coal-water slurry and coalesced into product coal agglomerates. This leads to a lower ash coal than could otherwise be produced by selective agglomeration of a raw coal.

Copending application Ser. No. 712,202, also assigned to the assignee of the present application, is similarly concerned with an agglomeration type process for recovering coal from mineral matter associated therewith. The process disclosed in that application however differs from the agglomeration type processes to which the '928 and '887 patents are devoted in that the raw coal being beneficiated is not milled or otherwise comminuted once it has been slurried. This requires that the coal being processed have a top size of not more than ca. 0.6 mm.

Coals processed as described in application No. 712,202 do not have the ultra low ash content of those beneficiated by the technique described in the '928 patent. Offsetting this, however, is the advantage that the cost of producing them is much lower because wet milling is not employed.

Unique in the processes described in the '928 and '887 patents and in application Ser. No. 712,202 is the use of an essentially pure compound as an agglomerant to effect a rapid and clean separation of the coal particles from the pa:ticles of mineral matter dispersed in the aqueous phase of the coal-water slurry.

The agglomeration steps of the coal cleaning processes disclosed in U.S. Pat. Nos. 4,484,928 and 4,186,887 are carried out in batch fashion in a mixer used to add agglomerant to the slurry and in a separator or reactor which may be a rotating drum or a spheroidizer. In the separator, the dissociation of the product coal from the mineral matter and aqueous phases of the slurry into which the raw coal is incorporated and the formation of product coal agglomerates, all initiated in the mixer, are continued and the agglomerates dimensionally stabilized; and water is expelled from the agglomerates, contributing to the quality of the product coal.

Because earlier initiated process steps—such as the milling of the coal to an appropriate size consist and the forming of the aqueous, coal-containing slurry—are carried out in continuous fashion, it becomes necessary to limit, and closely control, the residence time of the slurry in the reactor (i.e., the agglomeration time) to (typically) 60 seconds so that the reactor can accommodate the input of the slurry generated elsewhere in the system or accommodate high tonnage flows. Otherwise, it may become necessary to shut down the operations upstream of the separator from time-to-time; and this is uneconomical, if not impractical.

Similar considerations may make it necessary to limit and control the residence time of the slurry in a reactor in which an agglomeration type coal separation process as described in U.S. application Ser. No. 712,202 is being carried out.

Controlling or limiting the agglomeration time by mechanical measures is impractical because a change in agglomeration time entails changes throughout the coal cleaning system that are time-consuming and expensive to make and because seemingly inconsequential variations in the chemical make-up of the coal being processed can alter to a marked degree the time required for the separation and agglomeration of the product coal. Thus, if mechanical measures were relied upon to control residence time, plantwide changes might have to be made each time a different batch of coal was processed. We thus consider it impractical to mechanically alter the coal cleaning system to the extent necessary to produce an acceptable product every time a different coal is processed; and the ability to so process different coal is a desidaratum, if not a requisite, of a selective agglomeration type coal cleaning system.

SUMMARY OF THE INVENTION

Like those described in U.S. Pat. Nos. 4,484,928 and 4,186,887 and in application No. 712,202, the novel coal beneficiation processes disclosed and claimed herein employ selective agglomeration from an aqueous slurry to separate particles of coal from the mineral matter associated therewith; and we employ the previously disclosed process steps and parameters described above in our coal beneficiation processes. However, we have now solved the problem of controlling agglomeration time by a novel chemical approach which does not have those disadvantages of mechanical measures we discussed above.

In general, the approach to the control of agglomeration (or separator residence) time we use involves, in one aspect of that approach, preblending with the aqueous coal slurry or with the liquid agglomerant an additive which is capable of causing the coal surface to act as if the interfacial tension $\gamma_{13}$ between the coal particle surfaces and the aqueous carrier of the slurry were higher—thereby reducing the aqglomeration time—without decreasing the ability of the process to exclude mineral matter from the product coal. It is also important that, as this occurs, the interfacial tension between the agglomerant and water $\gamma_{23}$, is not changed significantly because we employ only limited amounts of additive. Depressing the agglomerant-water interfacial tension $\gamma_{23}$ would reduce the ability of the process to effect a clean separation between the coal particles and the associated particles of mineral matter dispersed in the aqueous phase of the coal-water slurry.

The ability to thus chemically control agglomeration time is important because, if the mixing of the agglomerant and slurry is insufficient (i.e., the agglomeration time is longer than the available mixing time), either the desired physical consistency of the agglomerates or a complete separation of the product coal from the coal-water slurry will not be obtained. In such circumstances, the novel controlled addition of the additives disclosed herein can be employed to reduce the agglomeration time to equal the available mixing time in which it is required that this part of the process be completed.

A related benefit of the present invention is that it may be employed to beneficiate coals which, because of their high oxygen content, require an impratically long, or even infinite, time to selectively agglomerate by the processes described in U.S. Pat. Nos. 4,484,928 and 4,186,887 and in copending application No. 712,202. Such coals can be rapidly agglomerated and product coal agglomerates with low ash contents generated by employing additives as described herein to reduce the agglomeration time to a practical level—again because seemingly incompatible goals of causing the coal to act as if its interfacial tension $\gamma_{13}$ with water were higher without depressing the agglomerant-water interfacial tensin $\gamma_{23}$.

In particular, coals with a high oxygen content (carbon content of 85 weight percent or lower) due to: (1) molecularly bound oxygen such as low rank bituminous Illinois No. 6 or the subbituminous coals from the Wyodak (Western) and Decker (Western) seams, or (2) oxidation of the coal cannot be selectively agglomerated in an acceptable fashion, if at all, without employing an agglomeration time-reducing additive in accord with the principles developed herein. However, as will become apparent hereinafter, such use of an appropriate additive makes it possible to generate product coals with ash contents of less than ca. one weight percent in only a few minutes, or even less than one minute in some cases, from those and other oxidized coals by selective agglomeration.

The reason that agglomerants such as those disclosed in the '887 and '928 patents and in the '202 application will not agglomerate high oxygen content coals is because the surface oxygen molecules are hydrogen bonded to the water in the slurry and cannot be replaced by wetting by the agglomerant. Coal wetting by the agglomerant is a prerequisite of agglomeration.

That an additive can produce an apparent increase in the interfacial tension between coal and water is important for we believe that the selective agglomeration of coal as proposed in U.S. Pat. Nos. 4,484,928 and 4,186,887 and in copending application No. 712,202 can be described in a macro sense (albeit not on the molecular level as selective agglomeration is not an averaging process) by the algorithm $$\Delta F = (\gamma_{12} - \gamma_{13}) + \gamma_{23}\left[\frac{1 - f^{2/3}}{(1 - f)^{2/3}}\right] \quad (1)$$

where:

ΔF is the free energy change per unit area of the coal particles as they go from a first state in which they are dispersed in the aqueous carrier of the slurry to a second state in which they have been separated from the liquid phase of the dispersed slurry and agglomerated;

$\gamma_{12}$ is the interfacial tension between the coal and the agglomerant in ergs/cm$^2$, $\gamma_{13}$ is the interfacial tension between the coal and the aqueous phase of the slurry in ergs/cm$^2$, $\gamma_{23}$ is the interfacial tension between the agglomerant and the aqueous phase of the slurry in ergs/cm$^2$, and f is the volume fraction of the agglomerant, based on the volume of the coal and mineral matter composite (i.e., the raw coal) on a dry basis.

For agglomeration to take place at all, the free energy ΔF must be negative; i.e., the interfacial tension $\gamma_{13}$ must be larger than the sum of the two positive terms on the right-hand side of the foregoing equation.

The estimation of the free energy for this process as applied to coal must include a surface energy averaging step because the surface of a coal particle is a patchwork of hydrophobic sites (paraffinic and aromatic organic molecules) and hydrophilic sites (polar organic molecules containing oxygen and nitrogen atoms and entrapped mineral matter). The proportion of the coal particle surface area controls the value of the free energy term ΔF in Equation (1) as well as the kinetics of the agglomeration process; i.e. the rate, or time, of agglomeration. Thus, a very hydrophobic coal (moisture and ash free carbon content in the range of 88 wt.%) separates in less than 30 seconds under standard conditions identified in the test protocol set forth below. A more hydrophilic coal such as a low ranked coal with high oxygen content or an oxidized higher ranked coal may take minutes or hours to separate by agglomeration. Or, possibly no agglomeration will take place in any time frame because the free energy has become positive, typically due to oxidation of the coal surfaces.

If chemical modification of the surfaces of the oxidized coal particles (often sub-micron in diameter) can be achieved to make them appear as if they were hydrophobic ($\gamma_3$ large), agglomeration separation can be achieved in a time as short as a few seconds. The Examples below demonstrate that this can be done and that the agglomeration process can be conducted successfully on oxidized coal by adsorbing small concentrations of selected additives on the polar sites of the coal particles without decreasing the interfacial tension $\gamma_{23}$ between the agglomerant and water and thereby causing the ash content of the product coal to increase. The consequence is a rapid and efficient separation of a low ash product coal from coal of any rank, or from oxidized coal, in an economic manner as the cost of the additives is low.

It is pointed out, in this respect, that the commercial surfactants cited in the '928 patent will also shorten agglomeration time by a mechanism which we have not identified. However, their high initial cost and the higher quantity needed to achieve effectiveness renders them uneconomical.

It is suggested by Equation (1) that the time required for the selective agglomeration of the coal being processed could also be controlled by varying the amount of agglomerant employed in the separation process. In practice, however, this approach is undesirable as even minor variations from the optimum concentration of agglomerant employed to process a given raw coal can result in significant increases in the ash content of that coal.

The additives which we use in the practice of the present invention to reduce the time required for agglomeration to be completed or to cause agglomeration to proceed in circumstances where it otherwise would not at a practical rate because of the high oxygen content of the raw coal are all organic compounds meeting two criteria.

First, they are no more than very slightly soluble in water (the lower the solubility, the better). A solubility of one percent is probably the maximum that can be tolerated as a practical matter because of the cost of the additive lost to the aqueous phase and thus incapable of effecting agglomeration of the slurry if the solubility is higher.

Second, to be usable for our purposes, the additive must have a molecular oxygen content in the range of 9 to 16 weight percent based on the total molecular weight of the compound.

The compositions which are suitable for our purposes include alcohols having six or more (preferably 6–10) carbon atoms with 2-ethylhexanol being preferred.

Another preferred additive is castor oil. The latter is a mixture of triglycerides of: ricinoleic, oleic, linoleic, palmitic, and stearic acids; it has an oxygen content of ca. 15 weight percent.

Long chain ($C_9$–$C_{18}$) fatty acids including those found in the form of their triglyceride derivatives in castor oil—ricinoleic, oleic, linoleic, palmitic, and stearic—and mixtures of those acids are also useful in controlling agglomeration times in accord with the principles of the present invention.

Such diverse compositions as hydrolized linseed oil and 2-ethylhexyl acetate are also useful for the purposes described herein.

Another class of additives that are effective for our purposes and attractive because of low cost are identified herein as "naturally occurring hydrocarbonaceous substances." Representative, operable members of that class are identified below in Table 1 along with preferred concentrations of the listed

TABLE 1

| | Preferred Concentration (gms/gm of coal) |
|---|---|
| Road Asphalts | 0.04 |
| Gilsonite | 0.02 |
| Tar Sands Oils | 0.1 |
| Coal Tars | 0.1 |
| Pentane Extracts from Various Coals* | <0.1 |

*Obtained by solvent extraction using pentane as the solvent

As will become apparent hereinafter, the concentration of an additive from Table 1 required in a given application of the invention may be an order of magnitude greater than the amount of a pure compound type additive such as 2-ethylhexanol required in the same circumstances. Nevertheless, the listed additive may still be preferred as its cost will typically be only a few pennies per pound, still giving the lower cost, additive an economic edge.

In another aspect, the present invention involves the use of additives to delay the onset of the agglomeration of the coal particles in coal cleaning processes as disclosed herein, thereby increasing the agglomeration time.

Those additives which are effective for this purpose are dispersants and, more specifically, dispersants which, when added to the coal-water slurry, cause the coal and mineral matter particles in the slurry to separate from each other, thereby lowering the viscosity of the slurry.

Both ionic and nonionic compounds are capable of retarding the agglomeration process without negatively affecting (i.e., increasing) the ash content of the product coal.

Preferred ionic dispersants include the ammonium salts of lignosulfonates (lignosulfonates are byproducts of the sulfite process of making paper).

A preferred nonionic dispersant is a dextrin $(C_6H_{10}O_5)_X$, a carbohydrate intermediate in character between starches and the sugars produced from starches.

There are definite upper and lower limits on the amount of additive that can be used in accord with the principles of our invention to control agglomeration time. Lower concentrations of additive are ineffective. Higher concentrations may decrease the interfacial tension ($\gamma_{23}$) between the agglomerant and the liquid phase of the coal-water slurry to the point where the ash content of the product coal is increased to an unacceptable extent.

Typically, larger concentrations of additive will be required to decrease the agglomeration time than will be necessary to increase it. And, as mentioned above, one can normally employ, with equivalent results, smaller amounts of a pure or relatively pure compound such as 2-ethylhexanol or larger amounts of a naturally occurring hydrocarbonaceous substance such as one of those listed in Table 1.

Up to 25 pounds per ton of raw coal (dry basis) of an additive which is a relatively pure compound can be employed for our purposes whereas 200 pounds per ton of a naturally occurring hydrocarbonaceous substance such as one of those listed above may be required for equivalent results. The maximum amount of agglomeration time-increasing additive we employ is ca. five pounds per ton of raw coal.

The additives disclosed herein also typically have the advantage that the product coal agglomerates generated when they are employed have a lower water content than would otherwise be the case. This is important in applications where a product coal with a "low" water content is required. The additive reduces, or even eliminates, the amount of water which may have to be removed from the product coal agglomerates. We employ mechanical expression and/or evaporation in circumstances where water removal is nevertheless required.

The novel selective agglomeration processes disclosed herein also require an agglomerating agent of particular character; viz., one that has an exceptionally high interfacial tension with water (at least 50 ergs/cm$^2$ and the higher the better) and a reasonably low viscosity. This is because agglomeration of the product coal particles involves attachment of the agglomerant to the particles of coal liberated in the milling step or initially present in the aqueous slurry and the encapsulation by liquid agglomerant of the coal particles making up each agglomerate. If the interfacial tension between the agglomerant and the aqueous phase of the coal slurry is not at least 50 ergs/cm$^2$. microspheres (or bubbles) of water and mineral matter can fill the voids between and around the coal particles making up the agglomerates. This undesirably increases both the moisture and ash content of the product coal. By using an appropriate amount of an agglomerant having an interfacial tension $\gamma_{23}$ with water of the magnitude identified above, however, the filling of the voids with agglomerant can be avoided, and the ejection of water and mineral matter from those voids into the aqueous phase of the slurry can be insured.

Agglomerants that possess the essential characteristics identified above and that are therefore suitable for our agglomeration type coal beneficiation processes include the following compounds:

Table 2

1,1,2-Trichloro-1,2,2-trifluoroethane
Trichlorofluoromethane
Butane and its isomers
n-Pentane and its isomers
n-Hexane and its isomers
n-Heptane and its isomers Essentially pure compounds are required as even small amounts of impurities markedly lower the interfacial tension $\gamma_{23}$) of the agglomerant with respect to water.

It will be apparent from the foregoing list that yet another important advantage of our invention is that the utilization of an additive in accord with its principles makes it possible to employ as agglomerants compounds which have attributes making them desirable for this purpose but which by themselves may not be satisfactory agglomerants. Compounds which can thus be promoted into useful and desirable agglomerants include butane, hexane, and heptane and the isomers of those compounds.

Often, the optimum reduction of ash in the product coal (depending on the coal and the particle size distribution) can be observed when very near 55 weight percent agglomerant has been dispersed on the coal particles. The use of agglomerant concentrations substantially in excess of 55 percent based on dry coal weight may result, not in selective agglomeration, but in unwanted partial or complete separation of one slurry containing liquid agglomerant and product coal from a second slurry of water and mineral matter.

Agglomerant concentrations of less than 45 percent may result in an unacceptably incomplete recovery of the coal particles from the coal-water slurry or agglomerates of unacceptable physical structure.

In view of the requirements and limitations identified in the preceding paragraphs, it is preferred that from 45 to 65 weight percent of the agglomerant be employed based on the dry weight of the raw coal.

One important advantage of the novel agglomerants identified above, aside from their high interfacial tension with water, is that they have a boiling point below that of water. This is particularly important when agglomeration and separation of the product coal is followed by redispersion of the coal particles in clean water, reagglomeration, and separation. Redispersion requires that the concentration of agglomerant with respect to the solids in the agglomerates be reduced in the presence of an aqueous carrier. That cannot be accomplished if the boiling point of the agglomerant is above 100° C. as the aqueous carrier will evaporate before the agglomerant when heat is added to strip off the agglomerant.

The relatively low boiling points of the listed agglomerants is also important because they all consequently remain liquid under most ambient conditions but can be dissociated from the product coal with only modest expenditures of energy. This is of import as the cost of the large volume of agglomerant used in a commercial scale separation requires that essentially all of the agglomerant be recovered and recycled in the process.

Another advantage of the listed agglomerants is that they all have a viscosity of less than one centipoise. This is important because, as a consequence of their low viscosity, these agglomerants can be easily and therefore economically dispersed in the slurry in a manner that will produce the requisite encapsulation of the coal particles by the agglomerant. Specifically, the transport of the liquid agglomerant from the water-solids-agglomerant mixture to the coal particles occurs by the impact of dispersed agglomerant on the coal particles and the subsequent wetting of the coal particles by the agglomerant. This process, which tends to homogenize the agglomerant distribution over all of the particles, requires that the viscosity of the agglomerant be below 10 centipoises; and the process becomes increasingly more efficient as the viscosity decreases below that maximum value so that an agglomerant with a viscosity of less than one centipoise is preferred.

Another advantage of the listed agglomerants is that they do not react with coal which is important for the reasons discussed in U.S. Pat. No. 4,173,530 issued Nov. 6, 1979, to Smith et al.

Numerous advantages of our novel coal beneficiation processes have been identified above. Furthermore, like the processes disclosed in U.S. Pat. Nos. 4,186,887 and 4,484,928 and in copending application Ser. No. 712,202, those to which this disclosure is directed: (1) are capable of making low ash coals available on commercial scales at dollar-per-million BTU costs which are competitive with alternatively employable fuels; (2) can be carried out in equipment that is relatively uncomplicated, that only needs low maintenance, that is simple to operate, and that can be made available with only a modest capital investment; (3) are non-polluting and energy efficient; (4) can ba carried out at ambient temperature and pressure; and (5) are capable of recovering up to nearly 100 percent of the coal from the raw coal that is processed even though the coal may be ground to sub-micron particle diameters.

Multistage agglomeration as described in U.S. Pat. No. 4,484,928 may be employed in the practice of the present invention. Also, the first of the agglomeration stages may be of the comminutionless character described in copending U.S. application Ser. No. 712,202. In such multistage applications, use of an agglomeration time-controlling additive as described herein is usually employed only in the first selective agglomeration of the raw coal.

THE PRIOR ART

It will be apparent from the foregoing that U.S. Pat. No. 4,484,928 and copending application Ser. No. 712,202 disclose coal cleaning processes which are like those disclosed herein to the extent that selective agglomeration is employed to recover the coal from the mineral matter associated therewith. However, there is nothing in the copending application suggesting the use of additives to control the agglomeration time in a selective agglomeration process, and the only relevant disclosure in the '928 patent deals with the use of a surfactant or a Lewis base to promote the agglomeration of lower rank and other partially oxidized coals. Lacking in the '928 patent, however, is any suggestion that the surfactants and Lewis bases contemplated by the patentee are operable unless the use of the additive is accompanied by comminution of the raw coal in the aqueous slurry.

The additives we employ are fundamentally different from those disclosed in the '928 patent in that their function is independent of such comminution. This is of considerable practical importance because, as was pointed out above, wet milling and its attendant cost can often be advantageously eliminated in the processes disclosed herein when an ultrapure product coal is not required. Economically, this is quite significant because up to 16 hours or more of wet grinding may be required to reduce the top size of the raw coal to one which is commensurate with the subsequent production of an ultrapure product coal.

In short, the additives employed in the novel selective agglomeration processes disclosed herein are fundamentally and advantageously different from those identified in the '928 patent in that their action in controlling agglomeration time is independent of whether or not the raw coal being processed is comminuted once the aqueous slurry of that coal has been formed and also independent of the extent to which any such comminution may he employed.

Furthermore, the additives we employ are not made obvious by the '928 patent because the patent disclosure does not specifically, or even by way of example, set forth the essential characteristics required for additives to be suitable for our purposes. For example, the definition of useful additives in the 928 patent includes compounds such as phenol (6COH). Phenol is not suitable for our purposes as it has high solubility in both water and coal.

Furthermore, the limitation of the additives in the '928 patent to compounds having a single hydroxyl group is inconsistent with our finding that compositions with more than one (OH) group, such as those in castor oil, are capable of controlling agglomeration times in the manner described herein. So are compounds not mentioned in the '928 patent such as those possessing the essential characteristics identified above and the formulas R—O—R, $R_2$—CO, R—COOH, and R—COOR or combinations thereof where R is an aliphatic or aromatic moiety having at least six carbon atoms.

In addition the '928 patent proposes that compounds of the formulas $RNH_2$, $R_2NH$, and $R_3N$ be used in the processes described therein. This may be undesirable as it is in many cases now preferred that the product coal contain as little nitrogen as possible. We can in any given application of our invention employ an additive which is nitrogen-free and therefore capable of promoting the generation of low nitrogen or nitrogen-free fuels.

We pointed out above that yet another selective agglomeration process which can be used to recover coal from associated mineral matter is disclosed in U.S. Pat. No. 4,186,887. The process described in the '887 patent is also fundamentally different from the novel, selective agglomeration processes described herein in that the patented process does not employ an additive to control the agglomeration time.

Processes which similarly involve selective agglomeration of coal with an essentially pure compound but do not employ an additive to control agglomeration time are described in U.S. Pat. Nos. 4,248,698 issued Feb. 2, 1981, to Keller, Jr.; 4,249,699 issued Feb. 10, 1981, to Smith et al.; and 4,388,181 issued June 14, 1983, to Rainis et al.

A process for recovering coal that is also similar to ours to the extent that coal is separated from associated mineral matter by comminution and agglomeration is disclosed in U.S. Pat. No. 3,268,071 issued Apr. 23, 1966, to Puddington et al. That process, however, differs significantly from ours by its use of liquids such as aliphatic hydrocarbon solvents, kerosene, lubricating oil, chlorinated biphenyls, and fuel oil to agglomerate the particles of coal generated in the patented process.

Certain disadvantages of such agglomerants including contamination of the product coal and the problem of recovering the agglomerant are identified in the '887 patent. Another perhaps more important disadvantage is that the Puddington et al. agglomerants are mixtures and not pure compounds as the agglomerants employed in the herein-disclosed selective agglomeration processes must be.

The Puddington et al. process is one of several variations of the Convertol process developed almost 70 years ago and described along with a number of other variations in AGGLOMERATION 77, Vol. 2, K.V.S. Sastry, Ed., American Institute of Mining, Metallurgical & Petroleum Engineers, Inc., New York, N.Y., 1977, chapters 54–56, pages 910–951.

Variations of the Convertol process are also described in the following U.S. Pat. Nos. issued to Reerink et al.: 2,744,626 dated May 8, 1956; 2,769,537 and 2,769,538 dated Nov. 6, 1956; 2,781,904 dated Feb. 19, 1957; 2,842,319 dated July 8, 1958; and 2,859,917 dated Nov. 11, 1958; in U.S. Pat. Nos. 3,045,818 issued July 24, 1962 to Muschenborn et al.; 3,637,464 issued Jan. 25, 1972, to Walsh et al.; 4,033,729 issued July 5, 1977, to Capes et al.; 4,261,699 issued Apr. 14, 1981, to Sun et al.; 4,270,927 issued June 2, 1981, to Burk et al.; 4,272,250 issued June 9, 1981, to Burk et al.; 4,302,211 issued Nov. 24, 1981 to Verschuur; and 4,311,488 issued Jan. 19, 1982, to Verschuur.

Quite aside from the above-discussed differences between our herein-disclosed processes and those described in the cited prior art, there is nothing in any of those items of prior art which in any way suggests that an additive as disclosed herein can be utilized in a selective agglomeration process, as we do, to delay the onset of agglomeration, and thereby increase the agglomeration time, in circumstances where this can be done to advantage.

OBJECTS OF THE INVENTION

One important and primary object of the present invention resides in the provision of novel, improved methods of preparing coal having a reduced ash content from a composite of coal and mineral matter.

Another also important and primary object of our invention resides in the provision of novel techniques for controlling the agglomeration times in coal beneficiation processes of the type in which coal is selectively agglomerated to separate it from mineral matter associated with the coal.

A related, also important and primary, object of our invention resides in the provision of novel, improved processes for recovering coal by selective agglomeration which are like those disclosed in U.S. Pat. Nos. 4,484,928 and 4,186,887 in that comminution of the raw coal in an aqueous medium is employed to minimize the ash content of the product coal but differ from the patented processes in that an additive is employed to control the agglomeration time.

A second related, also primary and important, object of the present invention resides in the provision of novel, impoved processes for recovering coal by selective agglomeration which are like those described in copending U.S. application Ser. No. 712,202 to the extent that there is no more than incidental comminution of the raw coal once it has been formed into an aqueous slurry but differ from the previously disclosed processes in that an additive is employed to control the agglomeration time.

Yet another important object of our invention resides in the provision of novel improved agglomeration type processes for recovering coal from mineral matter associated therewith in which an additive is employed to so shorten the agglomeration time as to make practical the selective agglomeration of a subbituminous, aged, slurry pond, or other coal of high oxygen content for which the agglomeration time has heretofore been impractically long or even infinite.

Other also important but more specific objects of our invention reside in the provision of processes in accord with the preceding objects:

in which provision is made for increasing the agglomeration time in a controlled manner;

in which provision is made for decreasing the agglomeration time in a controlled manner;

in which the desired control over the agglomeration time is exercised by preblending an appropriate additive with an aqueous slurry of the coal and the mineral matter from which the coal is to be separated;

in which the desired control over the agglomeration time is exercised by preblending an appropriate additive with the agglomerant employed to selectively agglomerate the coal and thereby separate it from the mineral matter associated therewith;

in which a chemical additive that: (1) is only slightly soluble in water, and (2) has an oxygen content in the range of 9 to 16 weight percent is employed to control the agglomeration time;

in which agglomeration times are controlled without significant increases in the ash content of the product coal agglomerates;

which do not affect the capability of the process of being carried out at ambient temperature and pressure;

in which an additive is employed to control agglomeration time and wherein that additive and the agglomerant employed to selectively agglomerate the coal are so selected as to make the free energy term, ΔF, negative in the algorithm $$\Delta F = (\gamma_{12} - \gamma_{13}) + \gamma_{23}\left[\frac{1 - f^{2/3}}{(1 - f)^{2/3}}\right]$$

where:

ΔF is the free energy change per unit area of the coal particles as they go from a first state in which they are dispersed in the aqueous carrier of the slurry to a second state in which they are separated from the liquid phase of the slurry and agglomerated;

$\gamma_{12}$ is the interfacial tension between the coal and the agglomerant in ergs/cm$^2$, $\gamma_{13}$ is the interfacial tension between the coal and the aqueous phase of the slurry in ergs/cm$^2$, $\gamma_{23}$ is the interfacial tension between the agglomerant and the liquid phase of the slurry in ergs cm$^2$, and f is the volume fraction of the coal based on the volume of the composite composed of the coal and the mineral matter associated therewith on a dry basis;

in which the control over agglomeration time is exercised by incorporating in a slurry of the coal and the mineral matter associated therewith an additive which is also capable of reducing the amount of water in the product coal agglomerates;

in which the control over the agglomeration time can be exercised without increasing the cost of the selective agglomeration process by more than a modest amount.

Still another important and primary object of our invention is the provision of product coal agglomerates which have an acceptably low ash content and an acceptable physical structure.

And a related, also important and primary object of our invention is the provision of product coal agglomerants which have the physical and chemical characteristics identified in the preceding object and which are produced by a time-controlled, selective agglomeration process as disclosed herein.

Other important objects and features and additional advantages of our invention will be apparent to the reader from the foregoing and the appended claims and from the ensuing detailed description of our invention which includes a test protocol, examples employing that protocol and showing how our invention can be practiced; and accompanying discussions of the results obtained from the process runs described in the examples.

DETAILED DESCRIPTION OF THE INVENTION

The tests summarized in the examples which follow are initiated by, if necessary, reducing the raw coal to a top size of not more than ca. 250 μm and a diameter not greater than 8 μm if optimum deashing is required or to a top size of not more than 0.6 mm (600 μm) and a mean diameter ≦30 μm if raw coal is dry ground in air in this step.

Three hundred grams of the raw coal and 700 grams of water are mixed together and placed in a standard ceramic laboratory ball mill (3.3 liter volume) charged with 50 percent of ⅜ inch alumina grinding media based on the volume of the mill. The charge is allowed to tumble for times ranging from 1 hour to 60 hours depending upon the desired product coal particle diameter which may lie in the range from 600 microns to less than one micron.

A 16-hour milling period is typically employed. This provides a product coal with a top size in the range of 8 μm and a mean diameter in the range of 2 μm. A top size and mean diameter of that magnitude (or even smaller) are required for optimum deashing of the raw coal and are used as a standard testing procedure.

The milled raw coal-water slurry is removed from the mill and further diluted with water to form a slurry which contains not more than 15 weight percent solids based on the total weight of the slurry.

Agglomeration is conducted in a standard household Waring blender operating at full speed. About 400 ml of the coal-water slurry is placed in the blender and blending commenced. From 50 to 55 volume percent n-pentane (based on the raw coal content of the slurry, dry basis) is added to the slurry with the blender running. Blending is continued until the coal particles separate from the aqueous phase of the slurry and the coal particles dispersed in that phase.

The agglomeration-time controlling additive is either: (a) mixed with the coal-water slurry or (b) mixed with the agglomerant before the latter is mixed with the slurry. The mixing of the additive into the raw coal slurry may be carried out in the blender. Mixing for a very short period is all that is required.

The premixing of the additive with the agglomerant prior to the addition of the agglomerant to the coal-water slurry may be effected with an implement as simple as a spoon or stirring rod as neither high shear nor other demanding types of mixing or more than a brief period of mixing are required.

EXAMPLE I

An aged (two-year-old) slurry of Blue Gem coal with an ash content of 5.74 weight percent was selectively agglomerated using the procedure described above and employing octanol (C80H) and 2-ethylhexanol (2-Et-C60H) to control the agglomeration time. The additives were blended directly into the slurry, and they were employed in the maximum amounts in which they were soluble in the aqueous phase of the slurry —17.6 pounds of C80H and 23.8 pounds of 2-Et-C60H per ton of dry coal.

In each run the coal was agglomerated, dispersed in water, and agglomerated a second time as described in U.S. Pat. No. 4,484,928.

The results of the tests are summarized in the following table:

TABLE 3

| Additive | Pounds/Ton of Coal | First Agglomeration Time | First Agglomeration Ash | Second Agglomeration Time | Second Agglomeration Ash |
|---|---|---|---|---|---|
| None | — | 1.2[1] | *[2] | —[1] | —[2] |
| C80H | 17.6 | 0.67 | 0.88 | 0.50 | 0.80 |
| C80H | 17.6 | 0.58 | 0.87 | 0.42 | 0.82 |
| 2-Et—C60H | 23.8 | 0.25 | 0.85 | 0.32 | 0.80 |

[1]Minutes
[2]Weight percent on a dry basis
*The agglomerates were unacceptably loose and not capable of efficient separation, and this run was accordingly discontinued.

The tabulated data show that both octanol and 2-ethylhexanol are effective to control agglomeration time in accord with the principles adduced herein. Of these two additives, 2-ethylhexanol (ca. 12 weight percent oxygen) may prove preferable because it is more pleasant to handle. It is also lower in cost than octanol, but this advantage may be offset by its higher solubility in water and consequent greater potential for being lost to the process.

Aside from the foregoing, the tabulated data show that a representative one of the agglomerants we employ, n-pentane, is not capable of selectively agglomerating an oxidized coal—the aged Blue Gem—unless an appropriate additive as disclosed herein is used in conjunction with that agglomerant.

EXAMPLE II

In the tests with which this example is concerned, the raw coal was the aged, slurried Blue Gem coal described in EXAMPLE I. The agglomeration time-controlling additive was 2-ethylhexanol.

In two of the runs the additive was premixed for one minute with the slurry which was then allowed to stand for 2.5 hours before the coal was agglomerated. In the other two runs the additive was premixed with the pentane agglomerant before the agglomerant was added to the slurry.

Two stages of agglomeration were employed.

The test results are tabulated below.

TABLE 4

| Run | Additive Addition Pounds/Ton of Coal (Dry Weight) | First Agglomeration Time[3] | First Agglomeration Ash[4] | Second Agglomeration Time[3] | Second Agglomeration Ash[4] |
|---|---|---|---|---|---|
| 1 | None | 1.2 | * | — | — |
| 2 | 23.8[1] | 0.50 | 0.84 | 0.37 | 0.72 |
| 3 | 11.9[1] | 0.83 | 0.81 | 0.37 | 0.77 |
| 4 | 11.9[2] | 0.42 | 0.85 | 0.25 | 0.74 |
| 5 | 6.0[2] | 0.67 | * | — | — |

[1]One minute of additive-slurry preblend followed by 2.5 hours of standing
[2]Additive preblended with the pentane agglomerant
[3]Minutes
[4]Weight percent based on the dry weight of the product coal
*The agglomerates were unacceptably loose and not capable of efficient separation, and this run was accordingly discontinued A comparison of the two runs where 11.9 pounds/ton of additive was respectively added to the slurry and to the agglomerant prior to agglomeration strongly suggests that the additive is partially "lost" to the aqueous phase of the slurry when it is mixed into the raw coal-water slurry and therefore becomes less effective as the additive dissolves into the aqueous phase.

When premixed with the agglomerant, the additive has less opportunity to reach its water solubility limit before agglomeration is completed. Consequently, there is less opportunity for the additive to dissolve into the aqueous phase of the slurry when this technique of incorporating the additive into the slurry is employed.

The tabulated data also confirm further: (1) that both octanol and its isomer, 2-ethylhexanol, can be employed to control agglomeration time when employed in the manner we have described herein, and (2) that this important goal can be obtained without increasing the ash content of the product coal even when a dramatic (for example, 79 percent) reduction in the agglomeration time is achieved.

EXAMPLE III

We pointed out above that additives can be employed as described herein to permit coals with a high molecular oxygen content such as those of the subbituminous type to be rapidly and completely separated from the mineral matter associated therewith in the raw coal by selective agglomeration (under standard conditions agglomeration with the recommended pure agglomerants will not occur). To demonstrate this, the procedure described above was repeated with Decker coal (a Western U.S.A. subbituminous coal with 4 weight percent ash). The additive, premixed with the agglomerant, was 80 pounds of castor oil (15 weight percent oxygen) per ton of raw coal (dry weight). The results are tabulated below:

TABLE 5

| Run | Agglomerated Product Coal Ash (Wt. %) |
|---|---|
| 1 | 1.10 |
| 2 | 1.12 |

TABLE 5-continued

| Run | Agglomerated Product Coal Ash (Wt. %) |
|---|---|
| 3 | 1.00 |

EXAMPLE IV

The tests with which this Example is concerned show the effect gained by varying the concentration of the additive. These tests were conducted on aged coal from the Blue Gem seam, and 2-ethylhexanol was employed as the additive. The additive was premixed with the agglomerant and the mixture added to the coal-water slurry as described above. The particulars of the tests and the test results are tabulated below:

TABLE 6

| Additive (gms/gm coal) | Agglomeration Time (Minutes) | Product Coal Ash (Wt. %) | Agglomerated Product Coal Water Content (Wt. %)* |
|---|---|---|---|
| None | 1.00 | 0.84 | 19.9 |
| 0.003 | 0.92 | 0.84 | 15.5 |
| 0.0058 | 0.67 | 0.85 | 18.0 |
| 0.01 | 0.42 | 0.89 | 19.1 |

*Based on dry coal content

The data in Table 6 shows that only six pounds per ton of additive sufficed to reduce the agglomeration time by eight percent while a modest 20 pounds per ton addition produced a massive 58% reduction in agglomeration time.

A second benefit of employing the additive in the foregoing tests was that the water content of the product coal agglomerates was significantly reduced (as much as 22 percent). This is important because, in applications requiring drying of the product coal, the energy needed to dry the coal by evaporation is proportionally reduced (10–15 percent in the test in question).

The time required to agglomerate the Blue Gem coal with which this example is concerned can be further reduced to 25 seconds by increasing the concentration of the 2-ethylhexanol to 0.01 gms/gm of coal with only a slight increase in product coal ash content and a larger increase in product coal water content.

EXAMPLE V

As discussed above, we have found that the time for which the additive is mixed with the raw coal-water slurry can have a marked effect on the time required to selectively agglomerate the coal. This is shown by tests in which the composition and amount of additive were held constant but the additive mixing time varied. The coal used in the tests was aged Blue Gem, and the additive was n-octyl alcohol. The results of these comparative tests is shown in the following table:

TABLE 7

| Mixing Time (Minutes) | Additive Addition (gms/gm coal) | Agglomeration Time (Minutes) | Product Coal Ash (Wt. %) |
|---|---|---|---|
| 5 | 0.009 | 0.67 | 0.88 |
| 2.5 | 0.009 | 0.58 | 0.87 |

Halving the mixing time produced a significant 16.4 percent reduction in the agglomeration time. The ash content of the product coal was essentially the same in both tests.

EXAMPLE VI

Tests as described above were conducted on a subbituminous coal from the Dietz seam (Decker Mine, Wyoming) and on aged bituminous coal from the Blue Gem seam. The additives employed were: castor oil, Surfynol 104E, and Triton X-114. Surfynol 104E and Triton X-114 are, respectively, a tertiary acetylenic glycol marketed by Air Products and Chemicals, Inc. as a nonionic surfactant and an octyl phenol with 7–8 oxide groups marketed by Rhom & Haas Co. as a nonionic surfactant.

The data obtained from these tests appear below in Table 8.

TABLE 8

| Coal Source (State) | Additive | Amount of Additive (Lbs./Ton) | Agglomeration Time (Minutes) |
|---|---|---|---|
| Subbituminous Dietz Seam (Wyoming) | None | 0.0 | Infinity |
| | Castor Oil | 2.0 | Infinity |
| | Surfynol 104E | 2.0 | Infinity |
| | Triton X-114 | 2.0 | Infinity |
| | Castor Oil | 80.0 | 3.3 |
| | Surfynol 104E | 80.0 | Infinity |
| | Triton X-114 | 80.0 | Infinity |
| Aged Bituminous Blue Gem Seam (Kentucky) | None | 0.0 | * |
| | Castor Oil | 2.0 | 3.3 |
| | Surfynol 104E | 2.0 | * |
| | Triton X-114 | 2.0 | * |

*Agglomeration was continued for five minutes and the test then discontinued due to insufficient agglomerate stability for subsequent processing The tabulated data confirm that there are definite lower limits on the amount of additive that is useful for our purposes; i.e., to bring about the selective agglomeration of coals which contain a high proportion of chemically bound oxygen, either because of their rank or because of oxidation. Castor oil, in particular, was ineffective in the tests involving subbituminous coal from the Dietz seam when used at a low rate. At a higher rate, however, this additive made it possible to selectively agglomerate that otherwise-impossible-to-agglomerate coal in a practical period of time.

The data in Table 8 also show that, contrary to what might be deduced from the '928 patent, surfactants as a class, or even the sub-classes of ionic and non-ionic surfactants, are not effective to control agglomeration times in accord with the principles of the present invention. In fact, the tabulated data show that two of the three representative ionic and non-ionic surfactants identified in the '928 patent—Surfynol 104E and Triton X-114 —are not capable of making highly oxidized coals such as the subbituminous one from the Dietz seam selectively agglomeratable, even at loadings as high as 80 pounds per ton of coal.

EXAMPLE VII

We pointed out above that, on occasion, it is desirable to delay the onset of agglomeration for a short period of time after the agglomerant is added to the coal-water slurry in order to increase the agglomeration time. We also pointed out that this goal can be achieved by incorporating in the slurry an additive which will cause the particles in the slurry to separate from each other, thereby reducing the apparent viscosity of the slurry. Appropriate additives include dextrins and ammonium lignosulfonates.

This example deals with the just-identified aspects of our invention. The tests employed Taggart seam coal from Wise County, Virginia and premixed loadings ranging from one to five pounds of additive per ton of coal. The additive was mixed with the slurry and preblended for about one minute. Parameters and results of the tests are tabulated below.

TABLE 9

| Additive | Pounds Per Ton (Dry Feed) | Agglomeration Time (Minutes) | Product Ash Content (Wt. % MF[3]) |
|---|---|---|---|
| None | 0.0 | 0.23 | 0.71 |
| Nadex 772[1] | 1.0 | 0.50 | 0.71 |
| Nadex 772[1] | 2.5 | 1.40 | 0.70 |
| Nadex 772[1] | 3.5 | 2.67 | 0.69 |
| Lignosol TSF[2] | 1.0 | 0.35 | 0.71 |
| Lignosol TSF[2] | 2.5 | 0.83 | 0.71 |
| Lignosol TSF[2] | 3.5 | 1.17 | 0.70 |
| Lignosol TSF[2] | 5.0 | 2.50 | 0.74 |

[1]A nonionic dextrin available from National Starch and Chemical Corp.
[2]An ammonium lignosulfonate supplied by Reed, Ltd., Chemical Division
[3]MF equals moisture free One conclusion that can be drawn from the tabulated data is that agglomeration times can be increased in a controlled fashion as facilely as the can be decreased by employing the principles of our invention. Equally significant is that this important goal can be reached and the agglomeration time substantially varied without any significant increase in the ash content of the product coal.

EXAMPLE VIII

We pointed out above that the coal particles contained in such finely divided raw coals as refuse pond coals and black water can be recovered from the mineral matter with which they are associated by selective agglomeration as disclosed in copending U.S. application No. 712,202 —i.e., without any further comminution of the raw coal in the beneficiation process. Even if such coals are oxidized, as they usually are, selective agglomeration of the coal particles can be effected in an acceptable period of time and with essentially complete separation of the coal particles from the associated mineral matter particles by incorporating an appropriate additive in the raw coal-water slurry from which the coal particles are retrieved by selective agglomeration.

We also pointed out that naturally occurring hydrocarbonaceous substances meeting the criteria specified above—for example, Gilsonite—and castor oil can be employed as additives to decrease agglomeration times in accord with the principles of our present invention.

The foregoing aspects of our invention are demonstrated by tests conducted essentially in accord with the protocol identified above except that the step of milling the slurried raw coal was omitted. The additives were added to the raw coal-water slurry and blended for about thirty seconds. Test parameters and results are presented in Table 10 below.

TABLE 10

| Raw Coal (Ash Content[2]) | Particle Size | Additive | Pounds/Ton Raw Coal (Dry Basis) | Agglomeration Time (Minutes) | Product Coal Ash (Wt. %) |
|---|---|---|---|---|---|
| Coal Refuse Pond - A[1] | 0.3 mm × 0 | None | 12 | No[3] | — |

TABLE 10-continued

| Raw Coal (Ash Content[2]) | Particle Size | Additive | Pounds/Ton Raw Coal (Dry Basis) | Agglomeration Time (Minutes) | Product Coal Ash (Wt. %) |
|---|---|---|---|---|---|
| (23.1 Wt. % Ash) | 0.3 mm × 0 | Castor Oil | | 11 | 4.4 |
| Flotation Fines - B[1] | 0.07 mm × 0 | None | 10 | 4 | 1.6 |
| (14.2 Wt. % Ash) | 0.07 mm × 0 | Gilsonite | | 0.5 | 1.0 |
| Flotation Fines - C[1] | 0.25 mm × 0 | None | 5 | No[3] | — |
| (12.3 Wt. % Ash) | 0.25 mm × 0 | Castor Oil | | 5 | 5.6 |
| Black Water - D[1] | 0.6 mm × 0 | None | 10 | No[3] | — |
| (34.8 Wt. % Ash) | 0.6 mm × 0 | Castor Oil | | 3 | 3.7 |
| Coal Refuse Pond - E[1] | 0.25 mm × 0 | None | 10 | No[3] | — |
| (56.3 Wt. % Ash) | 0.25 mm × 0 | Castor Oil | | 2 | 4.8 |

[1]Samples A-E are from the: U.S.A., U.K., U.S.A., France, and Australia in that order
[2]Weight Percent on a dry basis
[3]No Agglomeration — infinite separation time The data in Table 10 show that raw coals which could otherwise not be agglomerated readily could in periods as short as 2 to 11 minutes when an appropriate additive was employed to decrease the agglomeration time in accord with the principles of the present invention.

The tabulated data also show that both naturally occurring additives involved in the tests were effective even though modest amounts of the additives were employed by adding them to the raw coal-water slurry as mentioned in Example VIII.

Finally, the data show that raw coals with top sizes as large as 0.6 mm (600 μm) can readily be agglomerated into a low ash content product coal without further milling of those coals as would be required if they were being selectively agglomerated by the processes described in U.S. patents Nos. 4,484,928 and 4,186,887.

EXAMPLE IX

The tests with which this example is concerned were conducted in accord with the protocol described above except that the milling step was omitted in tests 7 and 8. These tests also show that naturally occurring substances can be employed as additives for our purposes and that our novel processes can be employed to selectively agglomerate oxidized coals which could be agglomerated only much more slowly, if at all, by the processes disclosed in U.S. Pat. Nos. 4,484,928 and 4,186,887 and in copending application No. 712,202.

Test parameters and results are tabulated in Table 11 below.

It is apparent from the tabulated data that a variety of naturally occurring substances can be used for our purposes. The subject data also further confirm that our invention can be employed to selectively agglomerate oxidized raw coals that could not otherwise be beneficiated by a process of that character and that wet milling is not an essential part of our process.

In the tests reported in Examples I–IX, the agglomeration time-controlling additive was either preblended with the agglomerant or premixed with the raw coal-water slurry after the agglomerant had been added to it. An alternate to those approaches, successfully employed in other tests, involves the simultaneous addition of the agglomerant and the additive to the slurry.

The invention may be embodied in still other specific forms without departing from the spirit or essential characteristics thereof. The embodiments of the invention disclosed above are therefore to be considered in all respects as illustrative and not restrictive. The scope of the invention is instead indicated by the appended claims, and all changes which come within the meaning and range of equivalency of the claims are intended to be embraced therein.

What we claim as our invention is:

1. A method of preparing a coal of reduced ash content from a composite of coal and mineral matter, said method comprising the steps of: forming an aqueous slurry of said composite in which the composite is resolved into coal particles and particles of mineral matter and in which the coal and mineral matter particles are dispersed in the aqueous carrier of the slurry; thereafter

TABLE 11

| Test Number | Coal (Ash Content)[3] | Additive | Pounds/Ton of Coal (Dry Weight) | Agglomeration Time (Minutes) | Product Coal Ash (Wt. %)[3] |
|---|---|---|---|---|---|
| 1 | Wyoming Subbituminous | None | 40 | No[2] | — |
| | (5.55 Wt. %) | Gilsonite | | 16 | 1.7 |
| 2 | Same | None | 200 | No[2] | — |
| | | Tar Sand[1] | | 60 | 1.0 |
| 3 | Same | None | 80 | No[2] | — |
| | | Road Asphalt | | 60 | 1.1 |
| 4 | Same | None | 200 | No[2] | — |
| | | Coal Tar | | 60 | 1.0 |
| 5 | Same | None | 40 | No[2] | — |
| | | 2-Ethylhexyl Alcohol | | 1 | 1.0 |
| 6 | Australian Lignite | None | 200 | No[2] | — |
| | (12.99 Wt. %) | Gilsonite | | 25 | 2.32 |
| 7 | Australian Pond Refuse | None | 50 | No[2] | — |
| | (40.7 Wt. %) | Gilsonite | | 5 | 2.30 |
| 8 | Flotation Fines (UK) | None | 10 | 4 | 1.6 |
| | (14.2 Wt. %) | Gilsonite | | 0.5 | 1.0 |

[1]California Tar Sand, a mixture of bitumen and sand
[2]No agglomeration of the coal particles
[3]All ash on a dry basis mixing with said slurry a liquid agglomerant which is capable of effecting a separation of the coal particles from the aqueous carrier and the mineral matter particles dispersed therein and a coalescence of those particles into product coal agglomerates; incorporating into said slurry an effective amount of an additive which is capable of reducing the time required for the separation of the coal particles from the aqueous carrier of the slurry and the formation of the product coal agglomerates, said additive having an oxygen content in the range of 9 to 16 mol percent and a solubility in water of not more than one percent; so agitating the resulting mixture as to effect the separation of said coal particles from said aqueous liquid and the mineral matter particles dispersed therein and the coalescence of said coal particles into product coal agglomerates; and recovering said agglomerates from said slurry.

2. A method as defined in claim 1 in which said additive is one which is capable of reducing the time required for the separation of the coal particles from the aqeuous carrier of the slurry and the formation of the agglomerates of said coal particles independently of whether, or the extent to which, the composite is comminuted after said slurry is formed.

3. A method as defined in claim 1 wherein the additive is employed in an amount ranging up to 200 pounds per ton, based on the dry weight of the composite of coal and mineral matter.

4. A method as defined in claim 1 wherein the additive is a naturally occurring hydrocarbonaceous substance.

5. A method as defined in claim 1 wherein the additive is selected from the following:
Octyl Alcohol and Its Isomers
Long Chain Fatty Acids
2- Ethylhexyl Acetate
Castor Oil
Hydrolized Linseed Oil
Isopropyl Ether
Gilsonite
Tar Sands Extracts
Road Asphalts
Coal Tars
Pentane Extracts of Coal.

6. A method as defined in claim 5 wherein the additive is 2-ethylhexyl alcohol and the maximum concentration of the additive is 25 pounds per ton, based on the dry weight of the coal and mineral matter composite.

7. A method as defined in claim 5 wherein the additive is castor oil.

8. A method as defined in claim 5 wherein the additive is a long chain fatty acid and wherein said acid has 9 to 18 carbon atoms.

9. A method as defined in claim 8 wherein the long chain fatty acid is a ricinoleic, oleic, linoleic, palmitic, or stearic acid.

10. A method as defined in claim 1 wherein the additive is a compound having the formula R—OH, R—O—R, $R_2$—CO, R—COOH, or R—COOR where R is an aliphatic or aromatic moiety having at least 6 carbon atoms.

11. A method as defined in claim 1 wherein the period provided for separation and agglomeration of the particles of coal upon the completion of the agglomerant addition is limited to a maximum of 60 seconds.

12. A method as defined in claim 1 wherein the coal in said composite is an oxidized raw coal or a low rank coal of high oxygen content.

13. A method as defined in claim 12 wherein said composite has a carbon content of not more than about 85 weight percent.

14. A method of preparing a coal of reduced ash content from a composite of coal and mineral matter, said method comprising the steps of: forming an aqueous slurry of said composite in which the composite is resolved into coal particles and particles of mineral matter and in which the coal and mineral matter particles are dispersed in the aqueous carrier of the slurry; thereafter mixing with said slurry a liquid agglomerant which is capable of effecting a separation of the coal particles from the aqueous carrier and the mineral matter particles dispersed therein and a coalescence of those particles into product coal agglomerates; incorporating into said slurry an effective amount of an additive which is capable of retarding the agglomeration of said coal particles without increasing the ash content of the agglomerates by causing said particles to separate from each other and thereby reduce the viscosity of the slurry; so agitating the resulting mixture as to effect the separation of said coal particles from said aqueous liquid and the mineral matter particles dispersed therein and the coalescence of said coal particles into product coal agglomerates; and recovering said agglomerates from said slurry.

15. A method as defined in claim 14 wherein said additive is an ionic dispersant or a nonionic dispersant.

16. A method as defined in claim 15 wherein the additive is an ammonium salt of a lignosulfonate.

17. A method as defined in claim 15 wherein the additive is a dextrin.

18. A method as defined in claim 14 wherein said additive is employed in an amount of not more than 5 pounds per ton of composite on a dry basis.

19. Agglomerated particles of coal produced by a method as defined in either of the preceding claims 1 or 14.

20. A method as defined in either of the preceding claims 1 or 14 wherein the agglomerant is a chlorofluorocarbon or a hydrocarbon having at least four carbon atoms.

21. A method as defined in claim 20 wherein the agglomerant is selected from the group consisting of:
1,1,2-Trichloro-1,2,2-trifluoroethane,
Trichlorofluoromethane,
Butane and its isomers,
n-Pentane and its isomers,
n-Hexane and its isomers, and
n-Heptane and its isomers.

22. A method as defined in claim 1 or in claim 14 and employing an agglomerant having an interfacial tension $\gamma_{23}$ with water of at least 50 ergs/cm$^2$.

23. A method as defined in claim 1 or in claim 14 wherein the volume fraction of the agglomerant is in the range of 45 to 65 percent.

24. A method as defined in claim 1 or in claim 14 wherein the agglomerant has an interfacial tension $\gamma^{23}$ with water of at least 50 ergs/cm$^2$ and wherein the volume fraction of the agglomerant is in the range of 45 to 65 percent.

25. A method as defined in claim 1 or in claim 14 in which said additive is premixed with said agglomerant before said agglomerant is added to said slurry.

26. A method as defined in claim 1 or in claim 14 wherein said additive is incorporated directly in said slurry prior to the separation and agglomeration of the coal particles.

27. A method as defined in claim 1 or in claim 4 wherein the composite of carbonaceous material and mineral matter is comminuted in said slurry to a size consist having a top size of about 600 μm or smaller and a mean diameter of about 30 μm or less.

28. A method as defined in claim 1 or in claim 14 wherein the composite of carbonaceous material and mineral matter has top size of not more than about 600 μm and is not comminuted after it is mixed with the aqeuous liquid to form a slurry.

29. A method as defined in claim 1 or in claim 14 wherein sufficient liquid is employed in said slurry to produce a solids content of not more than 15 percent based on the total weight of the slurry.

30. A method as defined in claim 1 or in claim 14 which employs an additive that is effective to reduce the amount of water trapped in the agglomerates of coal.

31. A method as defined in claim 30 wherein said additive is 2-ethylhexanol.

32. A method as defined in claim 30 which includes the step of evaporating water from said agglomerates.

33. A method as defined in claim 32 wherein said entrapped water is removed from the agglomerates of coal to reduce the moisture content thereof by mechanically expressing said water from said agglomerates before removing water therefrom by evaporation.

34. A method of preparing a carbonaceous material of reduced ash content from a particulate composite of said carbonaceous material and mineral matter, said method comprising the steps of: forming an aqueous slurry in which the composite is resolved into separate phases of particulate carbonaceous material and particulate mineral matter, those phases being dispersed in an aqueous, liquid phase; thereafter mixing with the slurry a liquid agglomerant and an additive which are so selected as to make the free energy term ΔF negative in the equation $$\Delta F = (\gamma_{12} - \gamma_{13}) + \gamma_{23}\left[\frac{1 - f^{2/3}}{(1 - f)^{2/3}}\right]$$

where:

ΔF is the free energy change per-unit-area of the particles of carbonaceous material as they go from a first state in which they are dispersed in the aqueous carrier of the slurry to a second state in which they are separated from the liquid phase of the slurry and agglomerated;

$\gamma_{12}$ is the interfacial tension between the carbonaceous material and the agglomerant in ergs/cm$^2$, $\gamma_{13}$ is the interfacial tension between the carbonaceous material and the aqueous phase of the slurry in ergs/cm$^2$, $\gamma_{23}$ is the interfacial tension between the agglomerant and the liquid phase of the slurry in ergs/cm$^2$, and f is the volume fraction of the agglomerant, based on the volume of the carbonaceous material and mineral matter composite on a dry basis;

so agitating the resulting mixture as to effect a separation of the particles of carbonaceous material from the aqueous phase of the slurry and the mineral matter particles dispersed therein and a coalescence of those particles into agglomerates of said carbonaceous material and recovering the agglomerates of carbonaceous material from the slurry.

35. A method as defined in claim 34 and employing an agglomerant having an interfacial tension $\gamma_{23}$ with water of at least 50 ergs/cm$^2$.

36. A method as defined in claim 34 wherein the volume fraction of the agglomerant is in the range of 45 to 65 percent.

37. A method as defined in claim 34 wherein the agglomerant has an interfacial tension $\gamma^{23}$ with water of at least 50 ergs/cm$^2$ and wherein the volume fraction of the agglomerant is in the range of 45 to 65 percent.

38. Agglomerated particles of a carbonaceous material produced by a method as defined in claim 34.

39. Agglomerated particles of a carbonaceous material as defined in claim 38 wherein the carbonaceous material is a coal.

40. A method as defined in claim 34 in which said additive is premixed with said agglomerant before said agglomerant is added to said slurry.

41. A method as defined in claim 34 wherein said additive is incorporated directly in said slurry prior to the separation and agglomeration of the coal particles.

42. A method as defined in claim 34 wherein the composite of carbonaceous material and mineral matter is comminuted in said slurry to a size consist having a top size of about 600 μm or smaller and a mean diameter of about 30 μm or less.

43. A method as defined in claim 34 wherein the composite of carbonaceous material and mineral matter is comminuted in the slurry to a top size of about 250 μm or smaller and a mean diameter of 8 μm or less.

44. A method as defined in claim 34 wherein the agglomerant has an interfacial tension with water of not less than 50 ergs cm$^2$.

45. A method as defined in claim 34 wherein the composite of carbonaceous material and mineral matter has a top size of not more than about 600 μm and is not comminuted after it is mixed with the aqueous liquid to form a slurry.

46. A method as defined in claim 34 wherein sufficient liquid is employed in said slurry to produce a solids content of not more than 15 percent based on the total weight of the slurry.

47. A method as defined in claim 34 in which said additive is one which is capable of increasing or decreasing the time required for the separation of the particles of carbonaceous material from the aqueous carrier of the slurry and the formation of the agglomerates of said carbonaceous material independently of whether, or the extent to which, the composite is comminuted after said slurry is fromed.

48. A method as defined in claim 47 wherein the additive is capable of reducing the time required for the separation of the carbonaceous material particles and the formation of agglomerates of those particles as aforesaid and wherein said additive is employed in an amount ranging up to 200 pounds per ton, based on the dry weight of the composite of carbonaceous material and mineral matter.

49. A method as defined in claim 47 wherein the additive is capable of reducing the time required for the separation of the carbonaceous material particles and the formation of agglomerates of those particles as aforesaid and wherein the additive is a naturally occurring hydrocarbonaceous substance.

50. A method as defined in claim 47 wherein the additive is capable of reducing the time required for the separation of the carbonaceous material particles and the formation of agglomerates of those particles as aforesaid and wherein the additive is selected from the following:

Octyl Alcohol and Its Isomers
Long Chain Fatty Acids
2-Ethylhexyl Acetate
Castor Oil
Hydrolized Linseed Oil
Isopropyl Ether
Gilsonite
Tar Sands Extracts
Road Asphalts
Coal Tars
Pentane Extracts of Coal.

51. A method as defined in claim 50 wherein the additive is 2-ethylhexyl alcohol and the maximum concentration of the additive is 25 pounds per ton, based on the dry weight of the carbonaceous material and mineral matter composite.

52. A method as defined in claim 50 wherein the additive is castor oil.

53. A method as defined in claim 50 wherein the additive is a long chain fatty acid and wherein said acid has 9 to 18 carbon atoms.

54. A method as defined in claim 53 wherein the long chain fatty acid is a ricinoleic, oleic, linoleic, palmitic, or stearic acid.

55. A method as defined in claim 47 wherein the additive is capable of reducing the time required for the separation of the carbonaceous material particles and the formation of agglomerates of those particles as aforesaid and wherein the additive is a compound having the formula ROH, R—O—R, $R_2$—CO, R—COOH, or R—COOR where R is an aliphatic or aromatic moiety having at least 6 carbon atoms.

56. A method as defined in claim 47 wherein the additive is capable of reducing the time required for the separation of the carbonaceous material particles and the formation of agglomerates of those particles as aforesaid and wherein the period provided for separation and agglomeration of the particles of carbonaceous material upon the completion of the agglomerant addition is limited to a maximum of 60 seconds.

57. A method as defined in claim 47 wherein the additive is capable of reducing the time required for the separation of the carbonaceous material particles and the formation of agglomerates of those particles as aforesaid, wherein the carbonaceous material in the composite is a coal, and wherein the coal in said composite is an oxidized raw coal or a low rank coal of high oxygen content.

58. A method as defined in claim 57 wherein said raw coal has a carbon content of not more than about 85 weight percent.

59. A method as defined in claim 34 wherein said additive has an oxygen content in the range of 9 to 16 percent and a solubility in water of not more than one percent.

60. A method as defined in claim 34 which employs an additive that is effective to reduce the amount of water trapped in the agglomerates of carbonaceous material.

61. A method as defined in claim 60 wherein said additive is 2-ethylhexanol.

62. A method as defined in claim 60 which includes the step of evaporating water from said agglomerates.

63. A method as defined in claim 62 wherein said entrapped water is removed from the agglomerates of carbonaceous material to reduce the moisture content thereof by mechanically expressing said water from said agglomerates before removing water therefrom by evaporation.

64. A method as defined in claim 34 in which said additive is one which is capable of retarding the agglomeration of said particles of carbonaceous material without increasing the ash content of the agglomerates by causing said particles to separates from each other and thereby reduce the viscosity of the slurry.

65. A method as defined in claim 64 wherein said additive is ionic dispersant or a nonionic dispersant.

66. A method as defined in claim 64 wherein the additive is an ammonium salt of a lignosulfonate.

67. A method as defined in claim 64 wherein the additive is a dextrin.

68. A method as defined in claim 64 wherein said composite of carbonaceous material and mineral matter is a raw coal and wherein said additive is employed in an amount of not more than 5 pounds per ton of composite on a dry basis.

69. A method as defined in claim 34 wherein the agglomerant is a chlorofluorocarbon or a hydrocarbon having at least four carbon atoms.

70. A method as defined in claim 69 wherein the agglomerant is selected from the group consisting of:

1,1,2-Trichloro-1,2,2-trifluoroethane,
Trichlorofluoromethane,
Butane and its isomers,
n-Pentane and its isomers,
n-Hexane and its isomers, and
n-Heptane and its isomers.

* * * * *